US010122097B2

(12) United States Patent
Kim et al.

(10) Patent No.: US 10,122,097 B2
(45) Date of Patent: Nov. 6, 2018

(54) MOLDED PORTION-EQUIPPED ELECTRIC WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Jisung Kim, Mie (JP); Masaharu Suetani, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/559,973

(22) PCT Filed: Mar. 27, 2016

(86) PCT No.: PCT/JP2016/057297
§ 371 (c)(1),
(2) Date: Sep. 20, 2017

(87) PCT Pub. No.: WO2016/158263
PCT Pub. Date: Oct. 6, 2016

(65) Prior Publication Data

US 2018/0076537 A1 Mar. 15, 2018

(30) Foreign Application Priority Data

Mar. 27, 2015 (JP) ..... 2015-066025

(51) Int. Cl.
*H01R 4/70* (2006.01)
*H01R 13/405* (2006.01)
(Continued)

(52) U.S. Cl.
CPC ..... *H01R 4/70* (2013.01); *H01R 4/183* (2013.01); *H01R 11/12* (2013.01); *H01R 13/405* (2013.01);
(Continued)

(58) Field of Classification Search
CPC ..... H01R 4/70; H01R 43/24; H01R 13/405; H01R 13/5216
See application file for complete search history.

(56) References Cited

U.S. PATENT DOCUMENTS 7,959,464 B2 * 6/2011 Mizutani ..... H01R 13/504 439/588
8,961,220 B2 * 2/2015 Hilbourne ..... H01R 13/516 439/502
(Continued)

FOREIGN PATENT DOCUMENTS

JP 2008258103 A 10/2008
JP 2014170639 A 9/2014

OTHER PUBLICATIONS

International Search Report for application PCT/JP2016/057297 dated May 31, 2016; 6 pages.
(Continued)

*Primary Examiner* — Ross N Gushi
(74) *Attorney, Agent, or Firm* — Reising Ethington, P.C.

(57) ABSTRACT

A molded portion-equipped electric wire includes an insulated electric wire, a terminal connected to a core wire at an end of the insulated electric wire, a first molded portion covering a portion at which the terminal and the core wire of the insulated electric wire are connected to each other, a
(Continued)

second molded portion that is formed integrally with the first molded portion, that is softer than the first molded portion, and that protrudes from the first molded portion toward the side opposite to the terminal side while being in contact with an outer circumferential surface of the insulating coating, and a fixing member that has an annular shape surrounding the second molded portion and that is attached to the first molded portion and the second molded portion in a state in which the fixing member presses the second molded portion against the outer circumferential surface of the insulating coating.

6 Claims, 3 Drawing Sheets

(51) Int. Cl.

| | |
|---|---|
| ***H01R 4/18*** | (2006.01) |
| ***H01R 11/12*** | (2006.01) |
| ***H01R 43/00*** | (2006.01) |
| ***H01R 13/58*** | (2006.01) |
| ***H01R 43/24*** | (2006.01) |
| *H01B 3/46* | (2006.01) |

(52) U.S. Cl.
CPC ..... *H01R 13/5812* (2013.01); *H01R 43/005* (2013.01); *H01R 43/24* (2013.01); *H01B 3/46* (2013.01)

(56) References Cited

U.S. PATENT DOCUMENTS

| | | | |
|---|---|---|---|
| 2008/0119078 | A1 | 5/2008 | Arai |
| 2012/0100572 | A1 | 4/2012 | Medoff |
| 2012/0149243 | A1 | 6/2012 | Ohnishi |

OTHER PUBLICATIONS

International Preliminary Report on Patentability for application PCT/JP2016/057297 dated Mar. 1, 2017; 8 pages.

* cited by examiner

MOLDED PORTION-EQUIPPED ELECTRIC WIRE

CROSS REFERENCE TO RELATED APPLICATIONS

This application claims the priority of Japanese patent application JP2015-066025 filed on Mar. 27, 2015, the entire contents of which are incorporated herein.

TECHNICAL FIELD

The present invention relates to a molded portion-equipped electric wire including a terminal, an insulated electric wire, and a molded portion.

BACKGROUND ART

In a terminal-equipped electric wire obtained by connecting a terminal to the end of an insulated electric wire, in some cases, the portion at which the electric wire and the terminal are connected to each other is covered with a molded portion obtained by insert molding.

Also, for example, an example in Patent Document 1 (JP2014-170639A) discloses a molded portion-equipped electric wire including a first molded portion and a second molded portion that are made of different mold resins.

SUMMARY

Incidentally, in order to prevent liquids such as water from entering between the molded portion and an insulating coating of the insulated electric wire, a rubber stopper is sometimes inserted between the molded portion and the insulating coating at a rear end of the molded portion.

Here, in order to obtain a higher water-stopping property, it is necessary to insert the rubber stopper between the molded portion and the insulated electric wire in a state in which the rubber stopper is relatively compressed. However, in this case, it is necessary to compress the rubber stopper with a relatively strong force and to insert the rubber stopper between the molded portion and the insulated electric wire while maintaining this compressed state, and thus there is a concern that it will be difficult to perform this operation.

An object of the present design is to provide technology for more easily suppressing the entry of liquids such as water between a molded portion and an insulating coating of an insulated electric wire in a molded portion-equipped electric wire.

A molded portion-equipped electric wire according to a first aspect includes an insulated electric wire including a core wire and an insulating coating covering the core wire, a terminal that is connected to the core wire at an end of the insulated electric wire, a first molded portion covering a portion at which the terminal and the core wire of the insulated electric wire are connected to each other, a second molded portion that is formed integrally with the first molded portion, that is softer than the first molded portion, and that protrudes from the first molded portion toward the side opposite to a terminal side while being in contact with an outer circumferential surface of the insulating coating, and a fixing member that has an annular shape surrounding the second molded portion, that is attached to the first molded portion and the second molded portion in a state in which the fixing member presses the second molded portion against the outer circumferential surface of the insulating coating, and that is a resin member that is harder than the second molded portion.

A molded portion-equipped electric wire according to a second aspect is one aspect of the molded portion-equipped electric wire according to the first aspect. In the molded portion-equipped electric wire according to the second aspect, the first molded portion is provided with a locking portion, the fixing member is provided with a locked portion that can be locked to the locking portion, and the fixing member is fixed to the first molded portion and the second molded portion in a direction in which the insulated electric wire extends, due to the locking portion and the locked portion engaging with each other.

A molded portion-equipped electric wire according to a third aspect is one aspect of the molded portion-equipped electric wire according to the second aspect. In the molded portion-equipped electric wire according to the third aspect, the second molded portion includes a first surface that faces the first molded portion and is in contact with an end surface of the first molded portion on the side opposite to the terminal side, and a second surface that faces away from the first molded portion, the fixing member includes a portion that is in contact with the second surface, and the fixing member is fixed due to the locking portion and the locked portion engaging with each other in a state in which the fixing member presses the second surface toward the first molded portion.

A molded portion-equipped electric wire according to a fourth aspect is one aspect of the molded portion-equipped electric wire according to any one of the first to third aspects. In the molded portion-equipped electric wire, the second molded portion includes a silicone resin.

A molded portion-equipped electric wire according to a fifth aspect is one aspect of the molded portion-equipped electric wire according to any one of the first to fourth aspects. In the molded portion-equipped electric wire according to the fifth aspect, the insulating coating includes a silicone resin.

A molded portion-equipped electric wire according to a sixth aspect is one aspect of the molded portion-equipped electric wire according to any one of the first to fifth aspects. In the molded portion-equipped electric wire according to the sixth aspect, the fixing member includes a plurality of fixing pieces and has the annular shape in a state in which the plurality of fixing pieces are assembled.

In the above-described aspects, the soft second molded portion protrudes from the first molded portion toward the side opposite to the terminal side. Moreover, the fixing member is attached to the first molded portion and the second molded portion in a state in which the fixing member presses the second molded portion against an outer circumferential surface of the insulating coating. Here, the second molded portion is obtained by injecting a mold resin into a metal mold and curing the resin, and thus can be obtained easily. Moreover, the entry of liquids such as water between the molded portion and the insulating coating of the insulated electric wire is suppressed by the fixing member pressing the second molded portion against the insulating coating. In this case, compared to a case where a rubber stopper is compressed and inserted between the molded portion and the insulating coating, the entry of liquids such as water between the molded portion and the insulating coating of the insulated electric wire can be suppressed more easily.

Also, in the second aspect, the fixing member is fixed to the first molded portion and the second molded portion by a locking portion formed in the first molded portion and a locked portion formed in the fixing member. In this case, the fixing member and the first molded portion, and the fixing member and the second molded portion can be more strongly fixed.

Also, in the third aspect, the fixing member includes a portion that is in contact with a second surface. The fixing member is fixed due to the locking portion and the locked portion engaging with each other in a state in which the fixing member presses the second surface toward the first molded portion. In this case, a surface of the first molded portion that is opposite to the terminal can be more strongly attached to the first surface. Thus, it is possible to more reliably suppress the formation of a gap that liquids such as water will enter, between the surface of the first molded portion that is opposite to the terminal and the first surface of the second molded portion.

Also, in the fourth aspect, the second molded portion includes a silicone resin. In this case, the second molded portion can be pressed against the insulating coating with a relatively small force, and thus a gap therebetween can be closed. Also, for example, when the insulating coating includes a silicone resin, the second molded portion and the insulating coating are made of the same material, and thus they are more strongly attached to each other.

Also, in the fifth aspect, the insulating coating includes a silicone resin. In this case, the flexibility of the insulated electric wire is increased. Also, for example, when the second molded portion includes a silicone resin, the second molded portion and the insulating coating are made of the same material, and thus they are more strongly attached to each other.

Also, in the sixth aspect, the fixing member has an annular shape in a state in which a plurality of fixing pieces are assembled. In this case, it is possible to more easily attach the fixing member to the first molded portion and the second molded portion.

DESCRIPTION OF EMBODIMENTS

Figure 1:
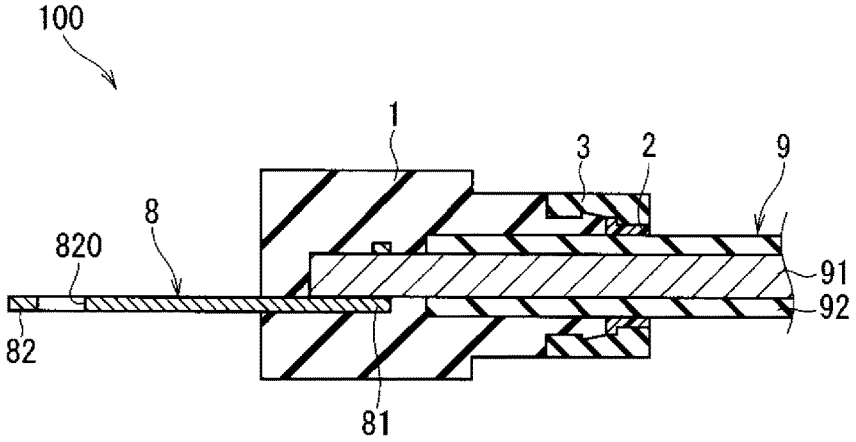
FIG. 1 shows a cross-sectional view of a molded portion equipped-electric wire according to a first embodiment.

Hereinafter, embodiments of the present design will be described with reference to the accompanying drawings. The embodiments below are merely specific examples of the present design, and are not to be construed as limiting the technical scope of the present invention.

First Embodiment

First, a molded portion-equipped electric wire 100 according to a first embodiment will be described with reference to FIGS. 1 to 3. The molded portion-equipped electric wire 100 includes an insulated electric wire 9, a terminal 8, a first molded portion 1, a second molded portion 2, and a fixing member 3.

FIG. 1 shows a cross-sectional view of the molded portion-equipped electric wire 100. FIG. 1 is a diagram showing the cross section obtained by cutting the molded portion-equipped electric wire 100 along a cutting line extending along a direction in which the insulated electric wire 9 extends. FIG. 2 shows a partially enlarged cross-sectional view of FIG. 1. FIG. 2 shows a cross-sectional view of an enlarged border portion between the first molded portion 1 and the second molded portion 2 in the molded portion-equipped electric wire 100. FIG. 3 shows a perspective view of the molded portion-equipped electric wire 100.

The molded portion-equipped electric wire 100 is provided in a vehicle such as an automobile, for example. In the molded portion-equipped electric wire 100, the first molded portion 1, the second molded portion 2, and the fixing member 3 stop water at a portion at which the insulated electric wire 9 and the terminal 8 are connected to each other.

In the molded portion-equipped electric wire 100, the insulated electric wire 9 includes a core wire 91 and an insulating coating 92 for covering the core wire 91. The core wire 91 is a conductor containing metal such as copper or aluminum as a main component, for example. The insulating coating 92 is an insulating member made of resin.

In this embodiment, the insulating coating 92 includes a silicone resin. Herein, it is conceivable that the insulating coating 92 is a rubbery silicone resin (silicone rubber). In this case, the flexibility of the insulated electric wire 9 is increased. It is also conceivable that the insulating coating 92 is a member made of a synthetic resin containing polyethylene or vinyl chloride as a main component, for example.

In the molded portion-equipped electric wire 100, the insulating coating 92 is removed from the core wire 91 at the end of the insulated electric wire 9. The terminal 8 is connected to the core wire 91 from which the insulating coating 92 is removed at the end of the insulated electric wire 9.

In the molded portion-equipped electric wire 100, the terminal 8 is connected to the core wire 91 at the end of the insulated electric wire 9. The terminal 8 is a member containing metal such as copper as a main component. Also, in the present embodiment, the terminal 8 includes an electric wire connection portion 81 and a counterpart connection portion 82.

In the present embodiment, the electric wire connection portion 81 is connected to the core wire 91 at the end of the insulated electric wire 9. Herein, as shown in FIG. 1, the electric wire connection portion 81 includes a crimping piece that can be crimped to the core wire 91 at the end of the insulated electric wire 9. In the electric wire connection portion 81, the crimping piece is crimped in a state in which the crimping piece covers the core wire 91 at the end of the insulated electric wire 9.

It is also conceivable that the electric wire connection portion 81 includes a crimping piece that is crimped to the insulating coating 92 at the end of the insulated electric wire 9. Also, it is conceivable that the terminal 8 is connected to the core wire 91 at the end of the insulated electric wire 9 by welding such as hot welding or ultrasonic welding. In this case, it is conceivable that the electric wire connection portion 81 is formed into a plate shape to which the core wire 91 at the end of the insulated electric wire 9 are welded, for example.

Also, in the present embodiment, the counterpart connection portion 82 can be connected to a counterpart member, which is a counterpart to which the terminal 8 is connected. It is conceivable that the counterpart member is a terminal board, for example. Herein, as shown in FIGS. 1 and 3, the counterpart connection portion 82 is provided with a hole 820 for allowing fastening of the counterpart member with a bolt.

Next, the first molded portion 1 will be described. In the molded portion-equipped electric wire 100, the first molded portion 1 covers the portion at which the terminal 8 and the core wire 91 of the insulated electric wire 9 are connected to each other. Note that in the present embodiment, the first molded portion 1 also covers the end of the insulating coating 92, in addition to the portion at which the terminal 8 and the core wire 91 of the insulated electric wire 9 are connected to each other. Therefore, herein, the first molded portion 1 has an annular shape that covers the end of the insulating coating 92 and the portion at which the terminal 8 and the core wire 91 are connected to each other.

The first molded portion 1 is harder than the second molded portion 2, which will be described later. A PBT (polybutylene terephthalate) resin, a PPS (polyphenylene sulfide) resin, a PPA (polyphthalamide) resin, an LCP resin (liquid crystal polymer), phenol resins, polyester resins, polyamide resins, and epoxy resins are conceivable as the resin for forming the first molded portion 1.

Also, in the present embodiment, the first molded portion 1 is provided with a locking portion 11. The locking portion 11 can be locked to the locked portion 31 of the fixing member 3, which will be described later. Herein, the locking portion 11 is formed at an end of the first molded portion 1 that is opposite to the counterpart connection portion 82 of the terminal 8. Hereinafter, the side of the first molded portion 1 that is opposite to the counterpart connection portion 82 side of the terminal 8 is referred to as "rear end side". That is, in the present embodiment, the rear end of the first molded portion 1 is provided with the locking portion 11.

In the present embodiment, the locking portion 11 protrudes from the radially inner side of the first molded portion 1 toward the radially outer side. Herein, the locking portion 11 is inclined, gradually descending from the most protruding portion toward the rear end. Also, in the locking portion 11, the portion of the most protruding portion that is opposite to the rear end protrudes from the radially inner side toward the radially outer side along a direction that is orthogonal to the direction in which the insulated electric wire 9 extends. That is, the rear end of the locking portion 11 is provided with an inclined surface, and a perpendicular surface that is orthogonal to the direction in which the insulated electric wire 9 extends is provided on the first molded portion 1 side of the locking portion 11.

Also, in the present embodiment, the portion of the locking portion 11 on the terminal 8 side is provided with a groove 15 into which the locked portion 31 of the fixing member 3, which will be described later, can be fit.

Next, the second molded portion 2 will be described. The second molded portion 2 is formed integrally with the first molded portion 1. Note that in the present embodiment, as described later, metal molds are shared and the first molded portion 1 and the second molded portion 2 are molded by two color molding. It is also conceivable that separate metal molds are prepared and the first molded portion 1 and the second molded portion 2 are molded by two molding processes.

The second molded portion 2 is softer than the first molded portion 1. In the present embodiment, the second molded portion 2 is a member including a silicone resin. For example, it is conceivable that the second molded portion 2 is a member obtained by curing liquid silicone.

In the molded portion-equipped electric wire 100, the second molded portion 2 is in contact with the outer circumferential surface of the insulating coating 92 and protrudes from the first molded portion 1 toward the side opposite to the terminal 8 side. That is, the second molded portion 2 protrudes toward the rear end of the first molded portion 1. Herein, the second molded portion 2 is formed only at the site of the insulating coating 92. That is, the second molded portion 2 has an annular shape covering the insulating coating 92.

Also, in the present embodiment, the second molded portion 2 includes a first surface 21 facing the first molded portion 1. Herein, the second molded portion 2 faces the first molded portion 1 and protrudes from the end surface of the first molded portion 1 that is opposite to the terminal 8, that is, protrudes from a rear end surface 19. Moreover, the first surface 21 of the second molded portion 2 is in contact with the rear end surface 19 of the first molded portion 1. Thus, the first surface 21 can also be referred to as "front end surface" of the second molded portion 2.

Also, the second molded portion 2 is provided with a level difference 25 from the first surface 21 to a rear end surface 29 opposite to the first surface 21. Herein, as shown in FIG. 2, a portion on the first surface 21 side protrudes outward more than a portion on the rear end surface 29 side due to the formation of the level difference 25.

Here, a surface facing the side opposite to the first molded portion 1 in the portion provided with the level difference 25 is referred to as "second surface 22". The second surface 22 is a surface opposite to the first surface 21 in the portion on the first surface 21 side. In the molded portion-equipped electric wire 100, the first surface 21 is pressed against the rear end surface 19 due to the fixing member 3, which will be described later, being in contact with the second surface 22.

Also, in the present embodiment, the second surface 22 is parallel to the first surface 21. In this case, it is possible to more efficiently press the first surface 21 against the rear end surface 19.

Next, the fixing member 3 will be described. The fixing member 3 is an annular member for surrounding the second molded portion 2. Note that in the present embodiment, the fixing member 3 is an annular member for also surrounding the rear end of the first molded portion 1, in addition to the second molded portion 2.

In the present embodiment, the fixing member 3 shrinks or stretches only insofar as it presses the second molded portion 2 against the insulating coating 92. Herein, the fixing member 3 is a resin member that is harder than the second molded portion 2. It is conceivable that the fixing member 3 is a member made of resin such as PP (polypropylene), nylon, or polyethylene, for example. Also, the fixing member 3 is a member separate from the first molded portion 1 and the second molded portion 2. The fixing member 3 is attached to the first molded portion 1 and the second molded portion 2 in a state in which the fixing member 3 presses the second molded portion 2 against the outer circumferential surface of the insulating coating 92.

In the present embodiment, it is conceivable that for example, in a state before the fixing member 3 is attached to the second molded portion 2, the contour formed by the inner circumferential surface of the fixing member 3 is smaller than the contour formed by the outer circumferential surface of the second molded portion 2 that surrounds the insulated electric wire 9. In this case, the second molded portion 2 is pressed toward the insulating coating 92 and deforms due to the fixing member 3 being disposed around the second molded portion 2. Accordingly, it is possible to eliminate a gap between the second molded portion 2 and the insulating coating 92.

It is also conceivable that the fixing member 3 is a crimping member. In this case, the second molded portion 2 is pressed against the insulating coating 92 by crimping the fixing member 3 that surrounds the second molded portion 2. Also, it is conceivable that the fixing member 3 is a tape member wound around in a state in which the fixing member 3 presses the second molded portion 2 against the insulating coating 92. Also, it is conceivable that the fixing member 3 is a member obtained by shrinking a heat-shrinkable tube.

Also, it is conceivable that the fixing member 3 has the same hardness as the first molded portion 1, or is harder than the first molded portion 1. Note that as in the present embodiment, if the fixing member 3 surrounds the rear end of the first molded portion 1 and the fixing member 3 is harder than the first molded portion 1, it is possible to press the rear end of the first molded portion 1 toward the insulating coating 92.

Also, in the present embodiment, the fixing member 3 is provided with a locked portion 31 that can be locked to the locking portion 11 of the first molded portion 1. Herein, as shown in FIG. 2, the locked portion 31 is a protruding portion that has a protruding shape on the inner circumferential surface side of the fixing member 3 and includes a locking surface 310 that is in contact with the surface of the locking portion 11 on the first molded portion 1 side.

In the present embodiment, the fixing member 3 approaches the terminal 8 from the rear end side of the first molded portion 1. Also, herein, the locking portion 11 is inclined so as to gradually descend from the portion on the terminal 8 side, which is the most protruding portion, toward the rear end, and thus the fixing member 3 approaches the terminal 8 while undergoing elastic deformation along this inclination.

Then, the locking portion 11 of the first molded portion 1 engages with the locked portion 31 of the fixing member 3. Accordingly, the fixing member 3 is attached to the first molded portion 1 and the second molded portion 2. Herein, as shown in FIG. 2, the locking portion 11 engages with the locked portion 31 due to the locked portion 31 being fitted into the groove 15 of the first molded portion 1. Moreover, the fixing member 3 is kept from moving in a direction away from the first molded portion 1 and the second molded portion 2 due to the locking surface 310 of the locked portion 31 being in contact with the locking portion 11. Also, the fixing member 3 is kept from moving toward the terminal 8 due to the surface that forms the groove 15 on the terminal 8 side being in contact with the surface of the fixing member 3 on the first molded portion 1 side. Accordingly, the fixing member 3 is fixed to the first molded portion 1 and the second molded portion 2 in the direction in which the insulated electric wire 9 extends.

Figure 2:
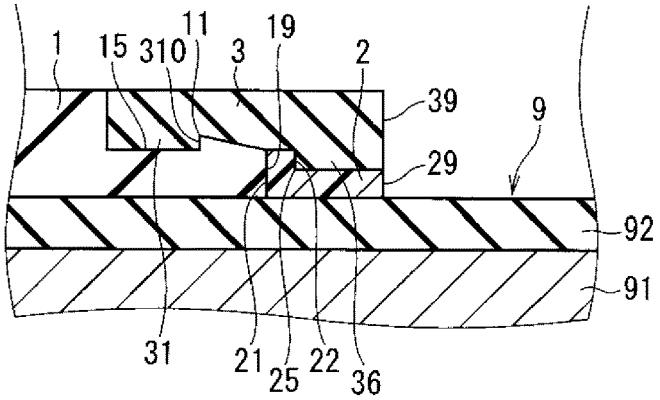
FIG. 2 shows a partially enlarged cross-sectional view of the molded portion equipped-electric wire according to a first embodiment.
Figure 3:
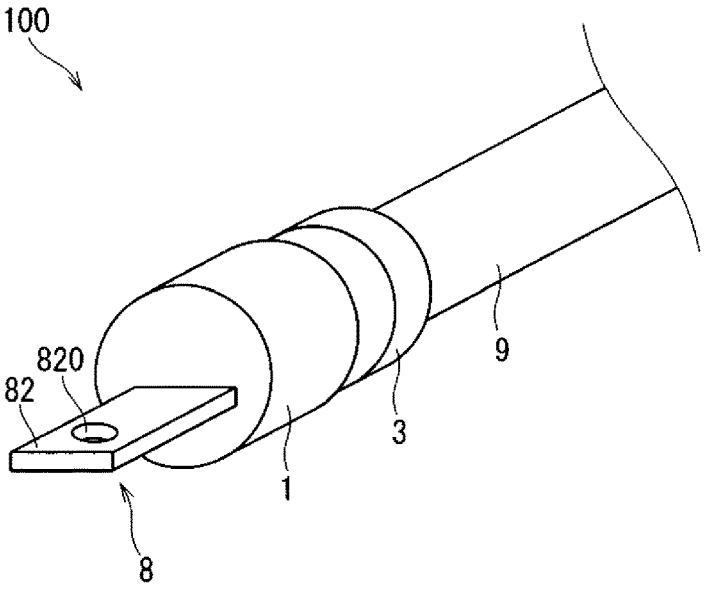
FIG. 3 shows a perspective view of the molded portion equipped-electric wire according to the first embodiment.

Also, in the present embodiment, as shown in FIG. 2, the fixing member 3 includes a portion that is in contact with the second surface 22 of the second molded portion 2. Hereafter, this portion is referred to as "contact portion 36". Herein, the contact portion 36 is a protruding portion forming a protruding shape on the inner circumferential surface of the fixing member 3. The contact portion 36 presses the second surface 22 against the first molded portion 1 when the fixing member 3 approaches the terminal 8 from the rear end side of the first molded portion 1. Accordingly, the portion including the first surface 21 of the second molded portion 2 is pressed against the first molded portion 1. As a result, the first surface 21 and the rear end surface 19 are strongly attached to each other. In a state in which the first surface 21 and the rear end surface 19 are attached to each other, the locking portion 11 and the locked portion 31 engage with each other and the fixing member 3 is fixed to the first molded portion 1 and the second molded portion 2, and thereby the attached state is maintained.

Also, the contact portion 36 may protrude by an amount corresponding to the height of the level difference 25 of the second molded portion 2. Preferably, the contact portion 36 may protrude by an amount that is larger than the height of the level difference 25. In this case, it is possible to efficiently press the second molded portion 2 against the insulating coating 92.

Also, in the present embodiment, in a state in which the fixing member 3 is attached to the first molded portion 1 and the second molded portion 2, the position of the rear end surface 39 of the fixing member 3 opposite to the first molded portion 1 and the position of the rear end surface 29 of the second molded portion 2 coincide with each other in the direction in which the insulated electric wire 9 extends. That is, no level difference is formed between the rear end surface 39 and the rear end surface 29. This is because, in the present embodiment, the first surface 21 and the rear end surface 19 are more strongly attached to each other due to the contact portion 36 of the fixing member 3 pressing the second surface 22 of the second molded portion 2. That is, the first surface 21 and the rear end surface 19 can be more strongly attached to each other without pressing the rear end surface 29 of the second molded portion 2 against the first molded portion 1. In this case, elimination of the portion covering the rear end surface 29 in the fixing member 3 makes it possible to reduce the size of the fixing member 3 in the direction in which the insulated electric wire 9 extends. That is, it is possible to reduce the size of a water stopping structure of the molded portion-equipped electric wire 100.

Note that in the present embodiment, it is also conceivable that the fixing member 3 further includes a portion covering the rear end surface 29 of the second molded portion 2.

Next, a molded portion-equipped electric wire manufacturing method for manufacturing a molded portion-equipped electric wire 100 will be described. Herein, the molded portion-equipped electric wire manufacturing method includes a step of molding the first molded portion (first molded portion molding step), a step of molding the second molded portion (second molded portion molding step), and a step of attaching the fixing member (fixing member attaching step). Moreover, in the molded portion-equipped electric wire manufacturing method, a metal mold 5 shared in the first molded portion molding step and the second molded portion molding step is used. That is, in the molded portion-equipped electric wire 100 obtained with a first manufacturing method, the first molded portion 1 and the second molded portion 2 can be obtained by two color molding.

Figure 4:
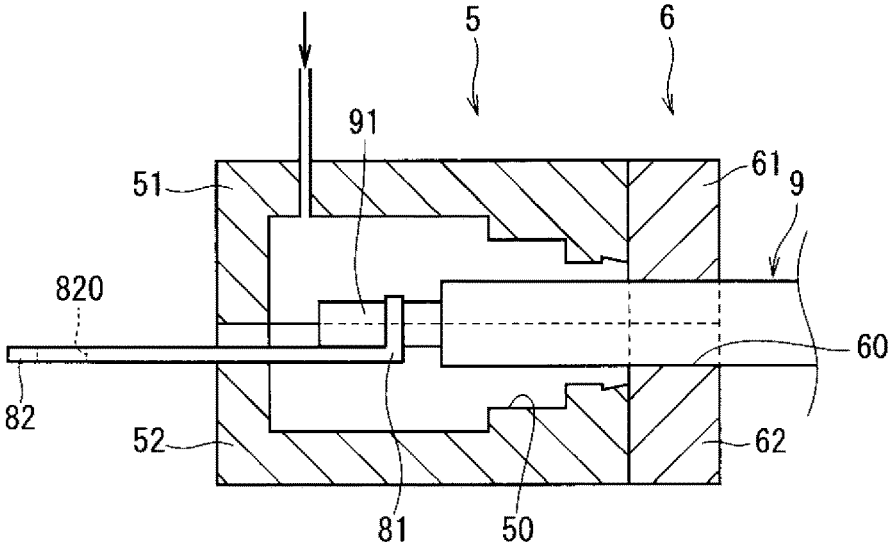
FIG. 4 is a diagram showing a method for manufacturing the molded portion equipped-electric wire according to the first embodiment.
Figure 5:
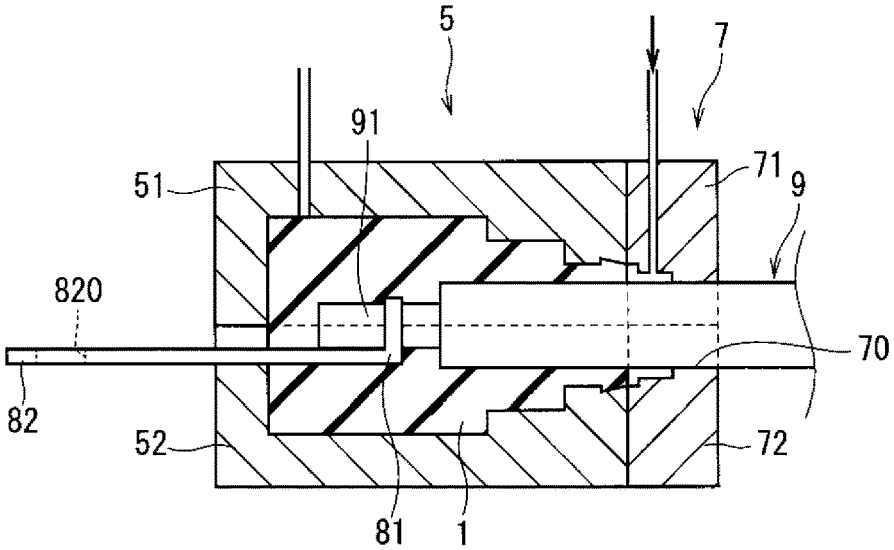
FIG. 5 is a diagram showing the method for manufacturing the molded portion equipped-electric wire according to the first embodiment.
Figure 6:
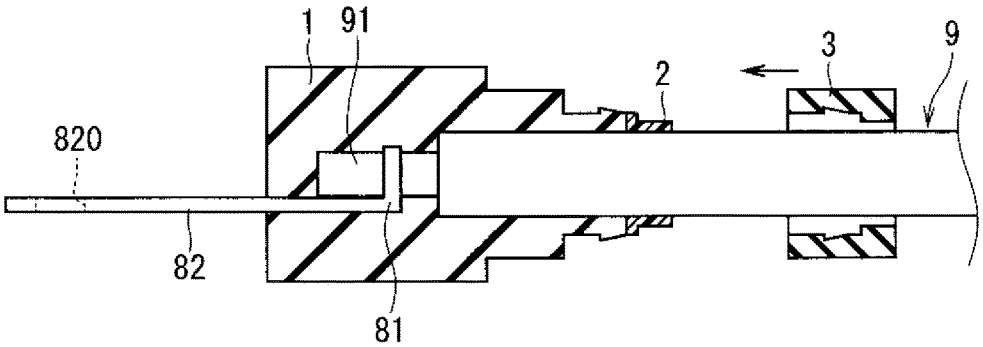
FIG. 6 is a diagram showing a method for manufacturing the molded portion equipped-electric wire according to the first embodiment.

FIG. 4 is a diagram showing the first molded portion molding step. FIG. 5 is a diagram showing the second molded portion molding step. FIG. 6 is a diagram showing the fixing member attaching step.

First, the metal mold 5 that is used and shared in the first molded portion molding step and the second molded portion molding step will be described. As shown in FIG. 4, in the present embodiment, the metal mold 5 is provided with a space 50 that is surrounded by the inner circumferential surface extending along the contour formed by the outer circumferential surface of the first molded portion 1. Also, herein, the metal mold 5 includes an upper metal mold 51 and a lower metal mold 52 that are supported such that the one can come close to or separate from the other. In this case, the space 50 is formed in a state in which the upper metal mold 51 and the lower metal mold 52 are in the closest state.

Next, a metal mold 6 used in the first molded portion molding step will be described. The metal mold 6 is provided with a space 60 surrounded by the inner circumferential surface extending along the contour formed by the outer circumferential surface of the insulating coating 92 of the insulated electric wire 9. Also, herein, the metal mold 6 includes an upper metal mold 61 and a lower metal mold 62 that are supported such that the one can come close to or separate from the other. In this case, the space 60 is formed in a state in which the upper metal mold 61 and the lower metal mold 62 are in the closest state. In the present embodiment, the metal mold 6 holds, supports, and fixes the insulated electric wire 9 in a state in which the upper metal mold 61 and the lower metal mold 62 are closest to each other.

In the present embodiment, as shown in FIG. 4, in the first molded portion molding step, the insulated electric wire 9 in which the terminal 8 is connected to the core wire 91 at the end of the insulated electric wire 9 is supported by the metal mold 6. Moreover, the upper metal mold 51 and the lower metal mold 52 are brought close to the terminal 8 and the insulated electric wire 9 such that a portion at which the terminal 8 and the core wire 91 of the insulated electric wire 9 are connected to each other is accommodated in the space 50.

Then, a mold resin that is to constitute the first molded portion 1 is poured into the space 50 in a state in which the portion at which the terminal 8 and the core wire 91 of the insulated electric wire 9 are connected to each other is accommodated in the space 50 of the metal mold 5. The first molded portion 1 is then formed by curing this mold resin.

Next, the second molded portion molding step will be described. In the present embodiment, after the first molded portion molding step, the second molded portion molding step is performed. Herein, a metal mold 7 is used in the second molded portion molding step. As shown in FIG. 5, the metal mold 7 is provided with a space 70 that is surrounded by the inner circumferential surface extending along the contour formed by the outer circumferential surface of the second molded portion 2. Also, herein, the metal mold 7 includes an upper metal mold 71 and a lower metal mold 72 that are supported such that the one can come close to or separate from the other. In this case, the space 70 is formed in a state in which the upper metal mold 71 and the lower metal mold 72 are in the closest state.

In the present embodiment, after the first molded portion 1 is formed, the upper metal mold 61 and the lower metal mold 62 are moved in the direction in which these metal molds are separated from each other, and the metal mold 6 is removed from the insulating coating 92 of the insulated electric wire 9. Then, the upper metal mold 71 and the lower metal mold 72 are brought close to the insulated electric wire 9 such that the portion from which the metal mold 6 is removed is accommodated in the space 70. Accordingly, the insulating coating 92 on the rear side of the first molded portion 1 is accommodated in the space 70 of the metal mold 7.

Then, a mold resin that is to constitute the second molded portion 2 is poured into the space 70 in a state in which the core wire 92 on the rear end side of the first molded portion 1 is accommodated in the space 70 of the metal mold 7. The second molded portion 2 is then formed by curing this mold resin. Note that in the present embodiment, the mold resin constituting the second molded portion 2 is liquid silicone. In this case, the mold resin is cured more quickly, and the second molded portion 2 can be obtained.

After the second molded portion molding step is complete, the insulated electric wire 9 to which the terminal 8 including the first molded portion 1 and the second molded portion 2 is connected is removed from the metal mold 5 and the metal mold 7. Then, the fixing member attaching step of attaching the fixing member 3 to the first molded portion 1 and the second molded portion 2 is performed.

It is conceivable that the fixing member 3 surrounds the insulated electric wire 9 in advance, or surrounds the insulated electric wire 9 by inserting, into the fixing member 3, the portion opposite to the side to which the terminal 8 of the fixing member 9 is connected.

In the present embodiment, in the fixing member attaching step, the fixing member 3 is brought closer to the terminal 8 from the rear end side of the first molded portion 1. The fixing member 3 is then fixed to the first molded portion 1 and the second molded portion 2 by the locking portion 11 of the first molded portion 1 and the locked portion 31 of the fixing member 3 engaging with each other.

Note that as another embodiment, the order of the first molded portion molding step and the second molded portion molding step may also change. Also, it is conceivable that in the first molded portion molding step and the second molded portion molding step, separate metal molds are prepared and the first molded portion 1 and the second molded portion 2 are molded by two molding processes.

Effects

In the present embodiment, the soft second molded portion 2 protrudes from the first molded portion 1 toward the rear end. The fixing member 3 is attached to the first molded portion 1 and the second molded portion 2 in a state in which the fixing member 3 presses the second molded portion 2 against the outer circumferential surface of the insulating coating 92. Here, the second molded portion 2 is obtained by injecting the mold resin into the metal mold 7 and curing the mold resin, and thus can be obtained easily. Moreover, the entry of liquids such as water between the second molded portion 2 and the insulating coating 92 of the insulated electric wire 9 is suppressed by the fixing member 3 pressing the second molded portion 2 against the insulating coating 92. In this case, compared to a case where a rubber stopper is compressed and inserted between the molded portion and the insulating coating, it is possible to more easily suppress the entry of liquids such as water between the insulating coating 92 of the insulated electric wire 9 and the first molded portion 1 and the second molded portion 2.

If a separate rubber stopper is inserted between the molded portion and the insulated electric wire at the rear end of the molded portion covering the portion at which the terminal and the electric wire are connected to each other, it is necessary to insert the rubber stopper while compressing, and this insertion operation is complicated. In particular, when a large rubber stopper is selected with consideration of tolerance of the size of the molded portion, compressing this rubber stopper is a relatively hard operation. Also, it is necessary to form a space for inserting the rubber stopper in the molded portion, and thus there is a concern that the size of the molded portion will increase.

On the other hand, in the molded portion-equipped electric wire 100 in the present embodiment, water can be stopped at the portion at which the terminal 8 and the core wire 91 are connected to each other without requiring such a hard operation that strongly compresses the rubber stopper. Also, even if the second molded portion 2 formed at the rear end of the first molded portion 1 has a small outer shape, water can be sufficiently stopped by eliminating the gap between the second molded portion 2 and the insulating coating 92 with the fixing member 3. That is, it is possible to suppress an increase in the size of the first molded portion 1 and the second molded portion 2.

Also, in the present embodiment, the fixing member 3 is fixed to the first molded portion 1 and the second molded portion 2 by the locking portion 11 formed in the first molded portion 1 and the locked portion 31 formed in the fixing member 3. In this case, engagement between the locking portion 11 and the locked portion 31 keeps the fixing member 3 from moving in the direction in which the insulated electric wire 9 extends. Thus, it is possible to make a fixed state stronger in which the fixing member 3 is fixed to the first molded portion 1 and the second molded portion 2.

Also, in the present embodiment, the fixing member 3 includes a portion that is in contact with the second surface 22. Moreover, the fixing member 3 is fixed by the locking portion 11 and the locked portion 31 engaging with each other in a state in which the fixing member 3 presses the second surface 22 toward the first molded portion 1. In this case, the rear end surface 19 and the first surface 21 can be more strongly attached to each other. Thus, it is possible to more reliably suppress formation of a gap into which liquids such as water will enter, between the rear end surface 19 of the first molded portion 1 and the first surface 21 of the second molded portion 2. As a result, it is possible to further increase its water-stopping property.

Also, in the present embodiment, the second molded portion 2 includes a silicone resin. In this case, the second molded portion 2 can be pressed against the insulating coating 92 with a relatively small force, and thus the gap therebetween can be closed.

Also, in the present embodiment, the second molded portion 2 is obtained by curing liquid silicone. In this case, it is possible to reduce a period of time required to cure the mold resin for the second molded portion 2. Also, it is possible to cure the resin at a relatively low temperature.

Also, in the present embodiment, the insulating coating 92 includes a silicone resin. In this case, the flexibility of the insulated electric wire 9 is increased. Herein, the second molded portion 2 also includes a silicone resin. Thus, the second molded portion 2 and the insulating coating 92 are made of the same material, and thus they are more strongly attached to each other.

Second Embodiment

Figure 7:
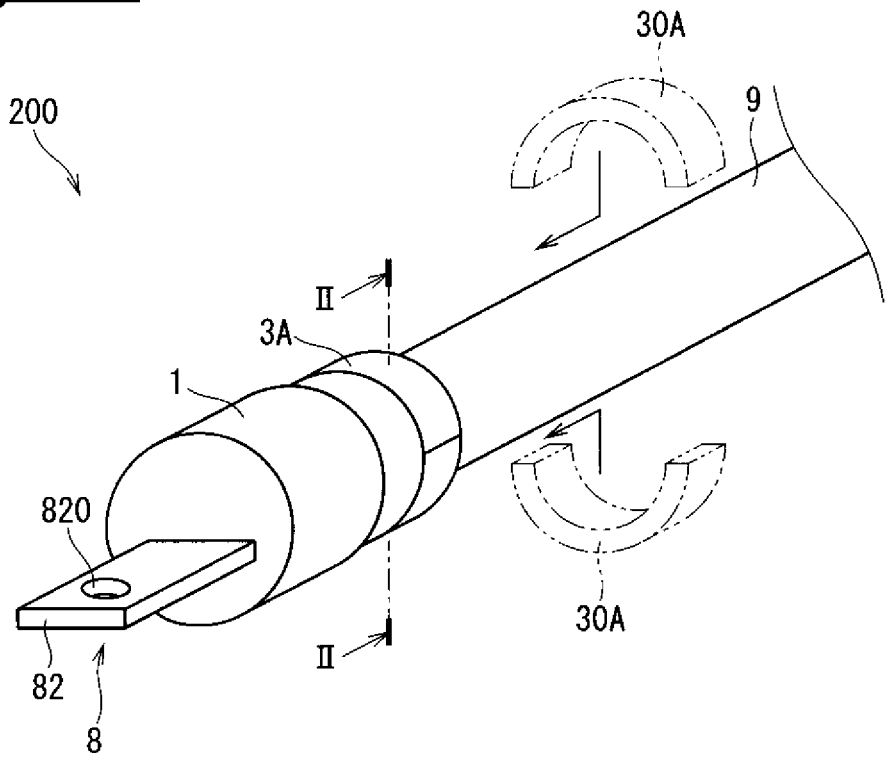
FIG. 7 shows a perspective view of the molded portion equipped-electric wire according to a second embodiment.
Figure 8:
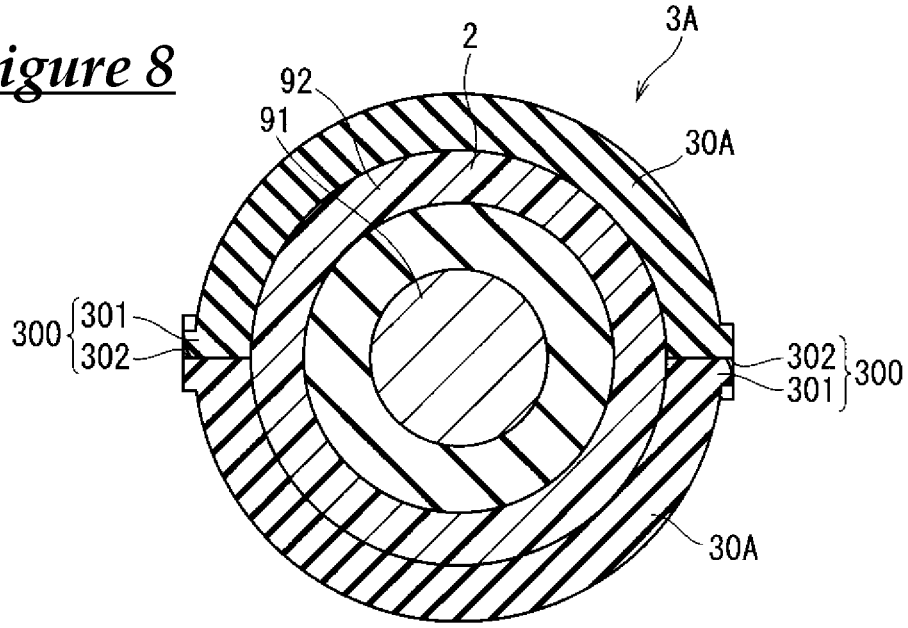
FIG. 8 shows a cross-sectional view of a fixing member of the molded portion equipped-electric wire according to the second embodiment.

Next, a molded portion-equipped electric wire 200 according to a second embodiment will be described with reference to FIGS. 7 and 8. The molded portion-equipped electric wire 200 is different from that in the first embodiment in that the molded portion-equipped electric wire 200 includes a fixing member 3A having a structure that is different from that of the fixing member 3. FIG. 7 shows a perspective view of the molded portion-equipped electric wire 200. FIG. 8 shows a cross-sectional view of the fixing member 3A. FIG. 8 shows a cross-sectional view taken along line II-II in FIG. 7. Note that constituent elements that are the same as the constituent elements shown in FIGS. 1 to 6 will be assigned the same reference numerals in FIGS. 7 and 8. Hereinafter, differences between the present embodiment and the first embodiment will be described.

The molded portion-equipped electric wire 200 includes a first molded portion 1, a second molded portion 2, the fixing member 3A, a terminal 8, and an insulated electric wire 9. Because the first molded portion 1, the second molded portion 2, the terminal 8, and the insulated electric wire 9 have configurations that are similar to those of the first embodiment, their description will be omitted.

In the present embodiment, the fixing member 3A includes a plurality of fixing pieces 30A. Moreover, the fixing member 3A has an annular shape in a state in which the plurality of fixing pieces 30A are assembled. Herein, as shown in FIGS. 7 and 8, the fixing member 3A includes two fixing pieces 30A. However, it is also conceivable that the fixing member 3A includes three or more fixing pieces 30A.

In the present embodiment, each of the plurality of fixing pieces 30A is provided with an assembly holding portion 300 for maintaining the annular assembled state. Herein, as shown in FIG. 8, a case where the assembly holding portion 300 includes a locking claw 301 and a locking hole 302 will be described. Note that the assembly holding portion 300 is omitted in FIG. 7 for convenience.

In the present embodiment, portions on the inner circumferential surface side of the fixing pieces 30A are brought close to each other in an opposed state, and the locking claws 301 are accommodated in the locking holes 302. Then, the state in which the two fixing pieces 30A are assembled is maintained by the locking claws 301 accommodated in the locking holes 302 being in contact with and engaging the inner edges of the locking holes 302.

Also, in the present embodiment, the fixing member 3A includes the same type of two fixing pieces 30A. In this case, the fixing member 3A can be constituted by one type of fixing piece 30A. Herein, the two fixing pieces 30A are assembled by the assembly holding portions 300 of the two fixing pieces 30A locking to each other, and the annular shape surrounding the second molded portion 2 is maintained.

It is also conceivable that, as another embodiment, the fixing member 3A includes fixing pieces that are continuous with hinges.

It is also conceivable that the fixing member 3A includes two types of fixing pieces. In this case, it is conceivable that one of the two types of fixing pieces is provided with the locking claw 301, and the other is provided with the locking hole 302.

In the present embodiment, the fixing member 3A for surrounding the insulated electric wire 9 can be obtained by bringing the two fixing pieces 30A in a state in which inner circumferential surfaces of the two fixing pieces 30A are opposite to each other, and the insulated electric wire 9 is disposed therebetween. As shown in FIG. 7, the fixing member 3A can be attached to the first molded portion 1 and the second molded portion 2 by bringing the fixing member 3A close to the first molded portion 1 and the locking portion 11 and the locked portion 31 engaging with each other. In this case, it is possible to more easily attach the fixing member 3A to the first molded portion 1 and the second molded portion 2.

Also, in the present embodiment, the fixing member 3A can be attached later in a method for manufacturing the molded portion-equipped electric wire 200. Thus, the degree of freedom of the manufacturing step is increased.

Note that the molded portion-equipped electric wire according to the present design can also be configured not only by freely combining the embodiments that have been described above but also by modifying the embodiments, or omitting parts thereof, as appropriate without departing from the scope of the invention as defined in the claims.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

1 First molded portion
100 Molded portion-equipped electric wire
11 Locking portion
2 Second molded portion
21 First surface
22 Second surface
3 Fixing member
31 Locked portion
8 Terminal
9 Insulated electric wire
91 Core wire
92 Insulating coating

The invention claimed is:

1. A molded portion-equipped electric wire comprising:

an insulated electric wire including a core wire and an insulating coating covering the core wire;

a terminal that is connected to the core wire at an end of the insulated electric wire;

a first molded portion covering a portion at which the terminal and the core wire of the insulated electric wire are connected to each other;

a second molded portion that is formed integrally with the first molded portion, that is softer than the first molded portion, and that protrudes from the first molded portion toward the side opposite to a terminal side while being in contact with an outer circumferential surface of the insulating coating; and a fixing member that has an annular shape surrounding the second molded portion, that is attached to the first molded portion and the second molded portion in a state in which the fixing member presses the second molded portion against the outer circumferential surface of the insulating coating, and that is a resin member that is harder than the second molded portion, wherein the fixing member is configured to be attached to the first molded portion and the second molded portion by one of axially sliding fit, radially press fit, tape winding fit, and heat-shrinking fit.

2. The molded portion-equipped electric wire according to claim 1, wherein the first molded portion is provided with a locking portion, the fixing member is provided with a locked portion that can be locked to the locking portion, and the fixing member is fixed to the first molded portion and the second molded portion in a direction in which the insulated electric wire extends, due to the locking portion and the locked portion engaging with each other.

3. The molded portion-equipped electric wire according to claim 2, wherein the second molded portion includes a first surface that faces the first molded portion and is in contact with an end surface of the first molded portion on the side opposite to the terminal side, and a second surface that faces away from the first molded portion, the fixing member includes a portion that is in contact with the second surface, and the fixing member is fixed due to the locking portion and the locked portion engaging with each other in a state in which the fixing member presses the second surface toward the first molded portion.

4. The molded portion-equipped electric wire according to claim 1, wherein the second molded portion includes a silicone resin.

5. The molded portion-equipped electric wire according to claim 1, wherein the insulating coating includes a silicone resin.

6. The molded portion-equipped electric wire according to claim 1, wherein the fixing member includes a plurality of fixing pieces and has the annular shape in a state in which the plurality of fixing pieces are assembled.

* * * * *